US006412667B1

(12) United States Patent
Huang

(10) Patent No.: US 6,412,667 B1
(45) Date of Patent: Jul. 2, 2002

(54) GLUE DISPENSING GUN

(75) Inventor: Chi-Chuan Huang, Chang Hua Hsien (TW)

(73) Assignee: Kai Shyun Enterprise Co., Ltd., Chang Hua Hsien (TW)

( * ) Notice: Subject to any disclaimer, the term of this patent is extended or adjusted under 35 U.S.C. 154(b) by 0 days.

(21) Appl. No.: 09/973,163

(22) Filed: Oct. 9, 2001

(51) Int. Cl.[7] ..... B67D 5/42
(52) U.S. Cl. ..... 222/327; 222/391
(58) Field of Search ..... 222/326, 327, 222/391

(56) References Cited

U.S. PATENT DOCUMENTS 5,052,243 A * 10/1991 Tepic ..... 222/391
5,192,008 A * 3/1993 Hwan ..... 222/391
5,370,282 A * 12/1994 Sedlmeier ..... 222/391
5,390,831 A * 2/1995 Schneider ..... 222/391
6,182,867 B1 * 2/2001 Keller ..... 222/391
6,286,729 B1 * 9/2001 Lin ..... 222/391

* cited by examiner

*Primary Examiner*—Joseph A. Kaufman
(74) *Attorney, Agent, or Firm*—Harrison & Egbert

(57) ABSTRACT

A glue dispensing gun includes a barrel, a center rod, an eccentric transmission member, and a trigger. The barrel is used to accommodate a glue container and is provided with a receiving slot in which the eccentric transmission member is located such that the eccentric transmission member is fastened to the trigger. The eccentric transmission member is formed of a guide block, a bearing and a push block. The guide block is actuated by the trigger to turn eccentrically so as to cause the push block to push a pushing piece of the center rod, thereby resulting in the forward movement of the center rod. The center rod is provided with a recovery spring and a retaining piece which is in contact with the bearing of the eccentric transmission member, thereby enabling the trigger to control the forward and the backward motions of the center rod.

2 Claims, 4 Drawing Sheets

GLUE DISPENSING GUN

BACKGROUND OF THE INVENTION

1. Field of the Invention

The present invention relates generally to a glue dispenser, and more particularly to a glue dispensing gun.

2. Description of Related Art

As shown in FIG. 1, a glue dispensing gun of the prior art comprises a barrel 11 to accommodate a glue container 10. The barrel 11 is provided at the rear end with a rear cap 12 which is fastened with a grip 14 having a trigger 13. The top of the grip 14 is fastened with a horizontal center rod 15 whose one end is put through the rear cap 12 to locate in the inside of the barrel 11. The center rod 15 is provided at the front end with an advancing piece 17 which is intended to urge a rear end cover 16 of the glue container 10. The center rod 15 is further provided with a compression spring 18, a pushing piece 19, a recovery spring 20, and a control piece 21. When the center rod 15 is activated by the trigger 13, the pushing piece 19 is actuated to cause the center rod 15 to displace forward so as to push the advancing piece 17, which puts a pressure on the rear end cover 16 of the glue container 10. The barrel 11 is provided at the front end with a front cap 22 and a glue discharging tube 23 for discharging the glue contained in the glue container 10 via the front cap 22.

Such a prior art glue dispensing gun as described above is defective in design because the control piece 21 is urged by the recovery spring 20 to be positioned at an inclination at such time when the center rod 15 displaces forward, thereby preventing the center rod 15 from moving backward. As a result, when the center rod 15 has moved forward to arrive at the final point, the center rod 15 cannot be caused by the trigger 13 to move backward. For this reason, the bottom end of the control piece 21 is pressed by a finger to free the center rod 15, which is then pulled backward with another hand. It is conceivably difficult to use the prior art glue dispensing gun. In addition, the recovery spring 20 and the control piece 21 are not shielded to provide them protection against rust or damage caused by impact.

In short, the prior art glue dispensing gun is inefficient at best.

BRIEF SUMMARY OF THE INVENTION

The primary objective of the present invention is to provide a glue dispensing gun which is efficient and free of the drawbacks of the prior art glue dispensing gun.

The glue dispensing gun of the present invention is basically similar in construction to the prior art glue dispensing gun. The glue dispensing gun of the present invention is characterized by an eccentric transmission member which is disposed in a receiving slot of the rear end of the barrel of the glue dispensing gun and is formed of a guide block, a bearing, and a push block. The guide block is eccentrically pivoted in the receiving slot such that the guide block is fastened with a connection rod of the trigger. The push block is rested against the pushing piece of the center rod. As the trigger is activated, the guide block of the eccentric transmission member is actuated to turn eccentrically so as to cause the push block to push the pushing piece of the center rod, thereby resulting in the forward movement of the center rod. In the meantime, the center rod is retained or released by a retaining piece, depending on the eccentric displacement of the bearing of the eccentric transmission member. The forward motion and the backward motion of the center rod are controlled by the trigger.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
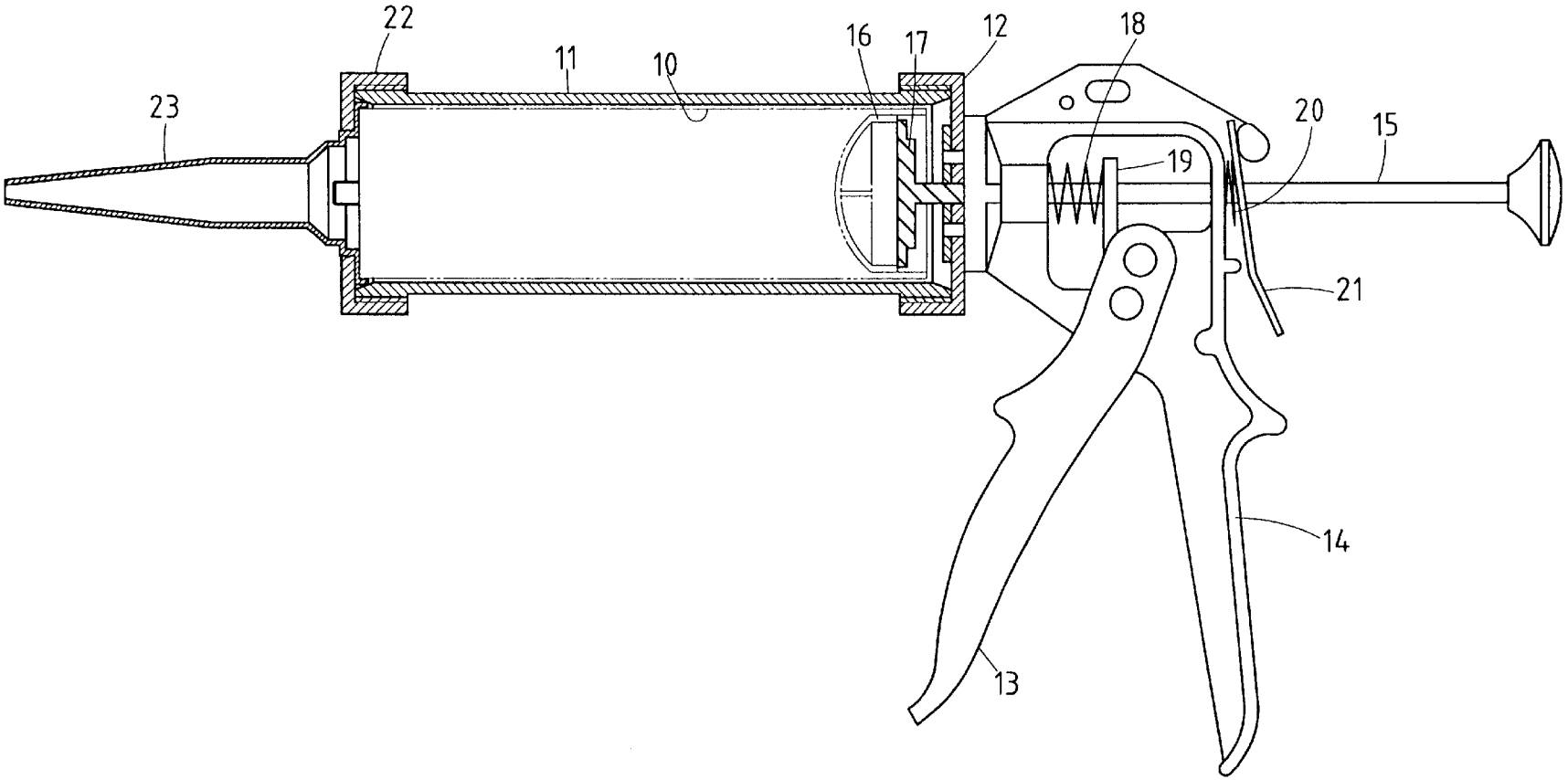
FIG. 1 PRIOR ART
FIG. 1 shows a sectional view of a glue dispensing gun of the prior art.
Figure 2:
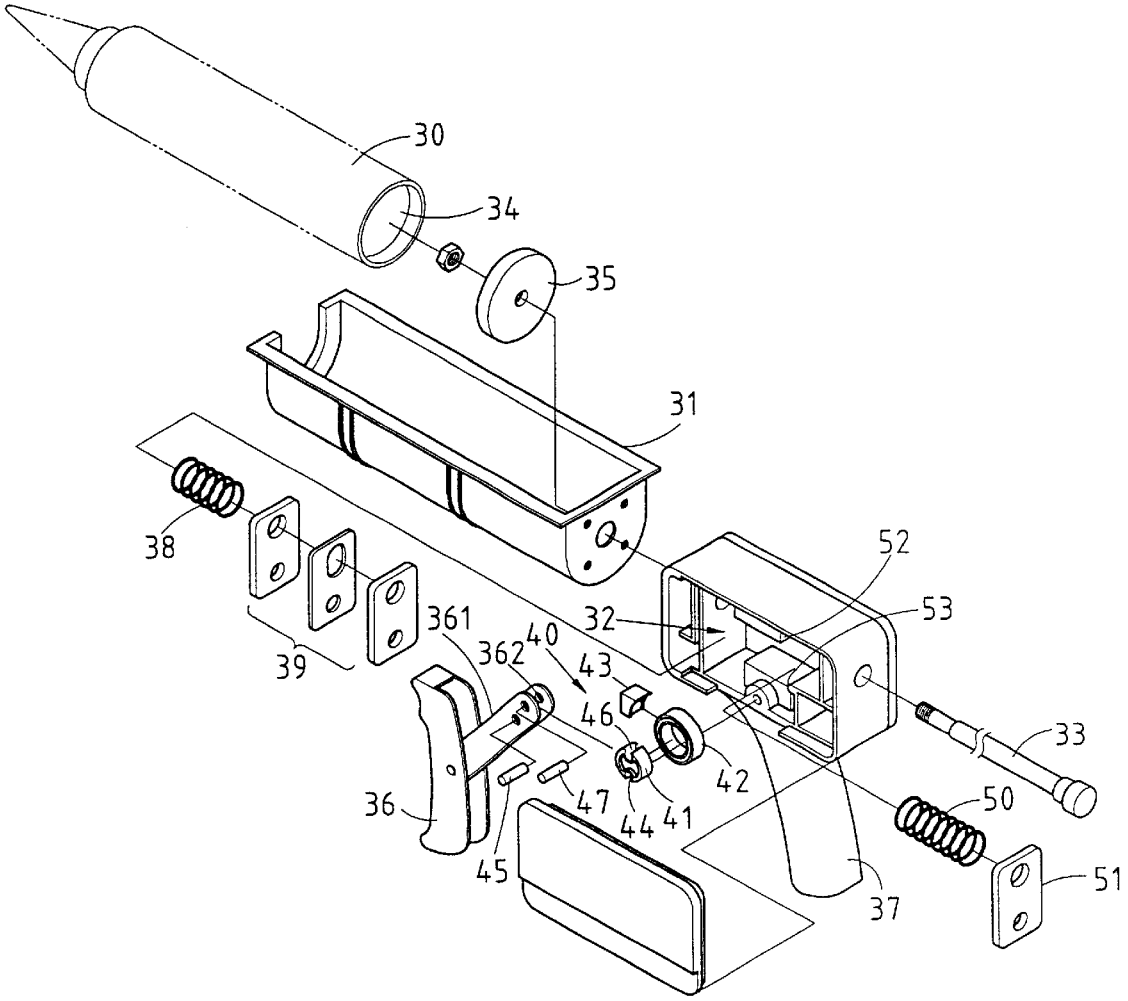
FIG. 2 shows an exploded view of the preferred embodiment of the present invention.
Figure 3:
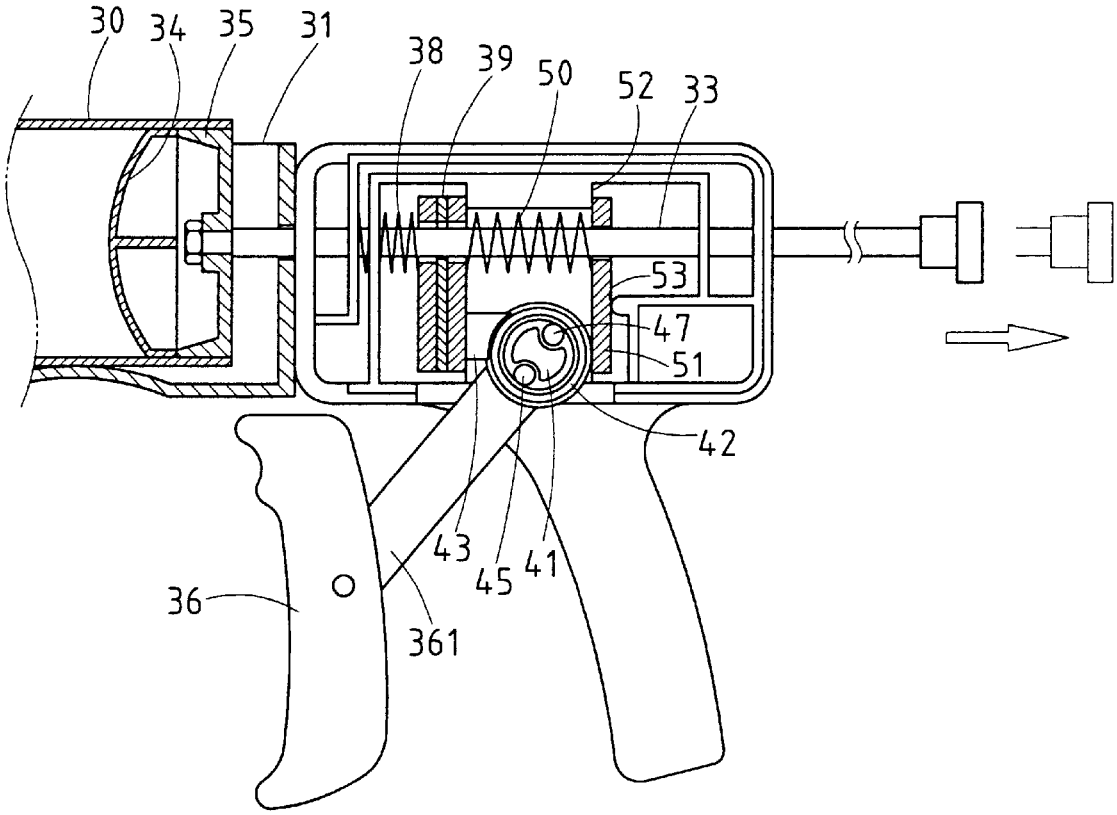
FIG. 3 shows a sectional view of the preferred embodiment of the present invention.
Figure 4:
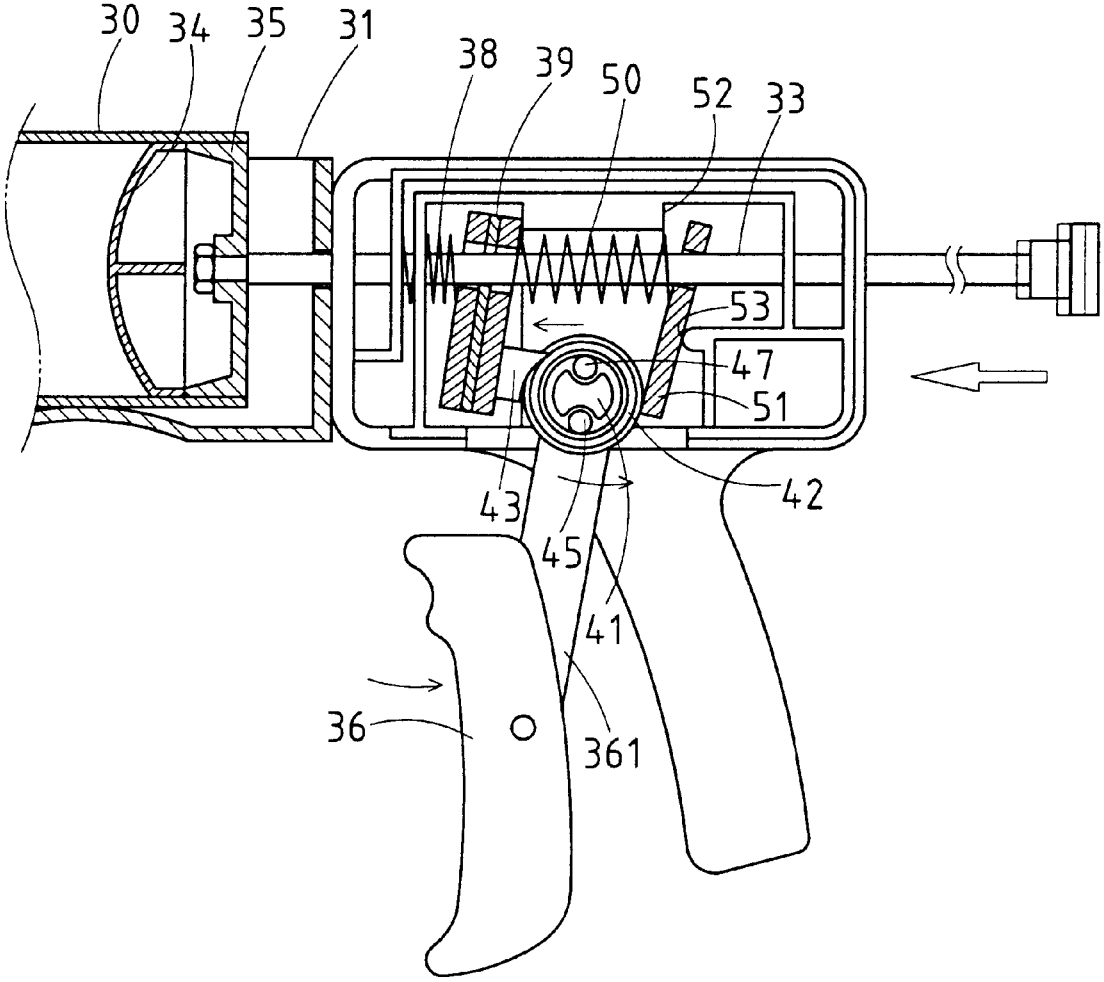
FIG. 4 shows a sectional schematic view of the preferred embodiment of the present invention at work.

As shown in FIGS. 2–4, a glue dispensing gun of the present invention comprises a barrel 31, a center rod 33, an eccentric transmission member 40, and a hand grip 37.

The barrel 31 is intended to receive a glue container 30 having a rear end cover 34. The barrel 31 is provided at a rear end with a receiving slot 32.

The center rod 33 has a front end which is located in the rear end of the barrel 31 via the receiving slot 32 and is provided with an advancing piece 35 in contact with the rear end cover 34 of the glue container 30. The center rod 33 is provided with a compression spring 38 and a pushing piece 39, which are fitted over the center rod 33. The center rod 33 is further provided with a recovery spring 50 and a retaining piece 51, which are fitted over the center rod 33.

The eccentric transmission member 40 is disposed in the receiving slot 32 of the barrel 31 such that the eccentric transmission member 40 is corresponding in location to the recovery spring 50 and the retaining piece 51 of the center rod 33.

The hand grip 37 has a trigger 36 which is fastened at one end with the eccentric transmission member 40 such that the trigger 36 controls the forward motion and the backward motion of the center rod 33.

The present invention is characterized by the eccentric transmission member 40 which is formed of a guide block 41, a bearing 42, and a push block 43. The guide block 41 is fastened with the top end of a connection rod 361 of the trigger 36 and is eccentrically provided with a pivoting hole 44. The guide block 41 is pivoted to the receiving slot 32 by the pivoting hole 44 thereof in conjunction with a pivot 45 such that the guide block 41 is actuated by the trigger 36 to turn eccentrically. The bearing 42 is fitted over the guide block 41 to facilitate the fastening of the push block 43 with the guide block 41 such that one end of the push block 43 is rested against the pushing piece 39 of the center rod 33. As the push block 43 turns along with the guide block 41, so as to push the pushing piece 39 to swivel slantingly to bring about the forward motion of the center rod 33. The bearing 42 is rested against by a lower end of the retaining piece 51. The retaining piece 51 is confined by a front stop edge 52 and a rear stop edge 53 of the receiving slot 32.

As shown in FIG. 3, when the trigger 36 is not activated, the pushing piece 39 of the center rod 33 is not pushed by the push block 43 of the eccentric transmission member 40 and is located vertically in relation to the center rod 33. In the meantime, the retaining piece 51 is confined by the front stop edge 52 and the rear stop edge 53 of the receiving slot 32 such that the retaining piece 51 is also located vertically in relation to the center rod 33. As a result, the center rod 33 is free to move backward. When the eccentric transmission member 40 is actuated by the trigger 36, as illustrated in FIG. 4, the lower end of the retaining piece 51 is no longer in contact with the bearing 42. In the meantime, the upper end of the retaining piece 51 is urged by the recovery spring 50, thereby causing the retaining piece 51 to tilt to prevent the center rod 33 from moving backward at the time when the center rod 33 is moving forward.

The recovery spring 50 and the retaining piece 51 are disposed in the receiving slot 32 such that they are protected from dirt, rust, and impact.

The guide block 41 of the eccentric transmission member 40 is further provided with a through hole 46 which is separated from the pivoting hole 44 by an appropriate distance. The connection rod 361 of the trigger 36 is provided at the top end with a through hole 362. The guide block 41 is fastened with the connection rod 361 of the trigger 36 by a blot 47 which is received in the through hole 46 of the guide block 41 and the through hole 362 of the connection rod 361 of the trigger 36.

I claim:

1. A glue dispensing gun comprising:

a barrel for receiving a glue container having a rear end cover, said barrel provided at a rear end with a receiving slot which is comprised of a front stop edge and a rear stop edge;

a center rod having a front end which is located in the rear end of said barrel via said receiving slot and is provided with an advancing piece in contact with the rear end cover of the glue container, said center rod being comprised of a compression spring and a pushing piece, said compression spring and said pushing piece being fitted over said center rod, said center rod being further comprised of a recover spring and a retaining piece, said recovery spring and said retaining piece being fitted over said center rod;

an eccentric transmission member mounted in said receiving slot of said barrel such that said eccentric transmission member is corresponding in location to said recovery spring and said retaining piece of said center rod; and a hand grip having a trigger, said trigger comprised of a connection rod fastened thereto such that a top end of said connection rod is fastened to said eccentric transmission member whereby said trigger controls a forward motion and a backward motion of said center rod in conjunction with said eccentric transmission member;

wherein said eccentric transmission member is comprised of a guide block, a bearing fitted over said guide block, and a push block fastened to said guide block such that one end of said push block is rested against said pushing piece of said center rod, said guide block being fastened to the top end of said connection rod of said trigger and provided eccentrically with a pivoting hole, said guide block being pivoted to said receiving slot by a pivot which is received in said pivoting hole of said guide block, said guide block being actuated by said trigger to turn eccentrically such that said push block turns along with said guide block so as to push said pushing piece of said center rod to swivel slantingly to bring about the forward motion of said center rod, said bearing being rested against by a lower end of said retaining piece of said center rod, with said retaining piece of said center rod being confined by said front stop edge and said rear stop edge of said receiving slot whereby said pushing piece of said center rod is not pushed by said push block of said eccentric transmission member and is positioned vertically in relation to said center rod at such time when said trigger is not activated, said retaining piece being confined by said front stop edge and said rear stop edge of said receiving slot such that said retaining piece is positioned vertically in relation to said center rod, thereby enabling said center rod to move backward whereby said eccentric transmission member is actuated by said trigger such that a lower end of said retaining piece of said center rod is no longer in contact with said bearing, and such that an upper end of said retaining piece of said center rod is urged by said recovery spring of said center rod, thereby causing said retaining piece to tilt to prevent said center rod from moving backward at the time when said center rod is moving forward.

2. The glue dispensing gun as defined in claim 1, wherein said guide block of said eccentric transmission member is comprised of a through hole whereby said through hole is separated from said pivoting hole of said guide block by a distance; wherein said connection rod of said trigger is provided at the top end with a through hole and is fastened to said guide block by a bolt which is received in said through hole of said connection rod of said trigger and said through hole of said guide block of said eccentric transmission member.

* * * * *